United States Patent [19]

DePenti

[11] 4,236,644

[45] Dec. 2, 1980

[54] WEARPLATE FOR THE BUTT END OF A COUPLER SHANK

[75] Inventor: Kenneth L. DePenti, Mayfield Heights, Ohio

[73] Assignee: Midland-Ross Corporation, Cleveland, Ohio

[21] Appl. No.: 121,931

[22] Filed: Feb. 15, 1980

Related U.S. Application Data

[63] Continuation of Ser. No. 891,743, Mar. 30, 1978, abandoned.

[51] Int. Cl.[3] ..... B61G 7/10

[52] U.S. Cl. ..... 213/62 R; 213/72

[58] Field of Search ..... 213/51, 61, 62 R, 64, 213/67 R, 69, 70, 71, 72; 308/DIG. 7; 52/716

[56] References Cited

U.S. PATENT DOCUMENTS

| | | | |
|---|---|---|---|
| 1,986,400 | 1/1935 | Kayler | 213/69 |
| 3,021,017 | 2/1962 | Cope et al. | 213/72 |
| 3,441,305 | 4/1969 | Trammell | 52/716 |
| 3,841,680 | 10/1974 | Muller | 52/716 |
| 3,860,121 | 1/1975 | Snell | 213/62 R |
| 4,055,254 | 10/1977 | Chierici et al. | 213/61 |
| 4,120,404 | 10/1978 | Chierici et al. | 213/61 |

*Primary Examiner*—Charles E. Frankfort
*Attorney, Agent, or Firm*—Harlan E. Hummer

[57] ABSTRACT

A car coupler having a coupler head with coupling structure and a shank extending from the coupler head and terminating at a butt end in which a configured recess is formed. A replaceable, nonmetallic wearplate is disposed within the recess and has an outer, convexly curved surface for resting in a concave seat of a front follower, and matingly inclined surfaces on the wearplate and recess for frictionally holding the wearplate within the recess.

9 Claims, 6 Drawing Figures

WEARPLATE FOR THE BUTT END OF A COUPLER SHANK

This is a continuation, of application Ser. No. 891,743, filed Mar. 30, 1978 now abandoned.

BACKGROUND OF THE INVENTION

U.S. Pat. No. 3,860,121 relates to a replaceable metal bearing block which is removably fastened by welding to the butt end of a coupler shank. This particular metal bearing block is a narrow segment of a sphere and does not provide adequate coverage of a normally, convexly curved butt end of the coupler shank. Other portions of the butt end of the coupler shank are subject to wear which can eventually destory the coupler shank. The invention is directed to solving this problem by the provision of a highly improved wearplate for protecting the butt end of a coupler shank.

Briefly stated, the invention is in a coupler having a shank extending from the coupler head and terminating at a butt end which is normally convexly curved. In this case, the butt end is flat and provided with a configured recess which extends inwardly of the shank in the direction of the coupler head. A replaceable, non-metallic wearplate is disposed in the recess and has an outer convexly curved surface which corresponds to the normal curvature of a conventional butt end of a shank. The wearplate is provided with means for frictionally engaging the butt end of the shank to hold the wearplate in the recess.

DESCRIPTION OF THE DRAWING

The following description of the invention, will be better understood by having reference to the annexed drawing, wherein.

DESCRIPTION OF THE INVENTION

Figure 1:
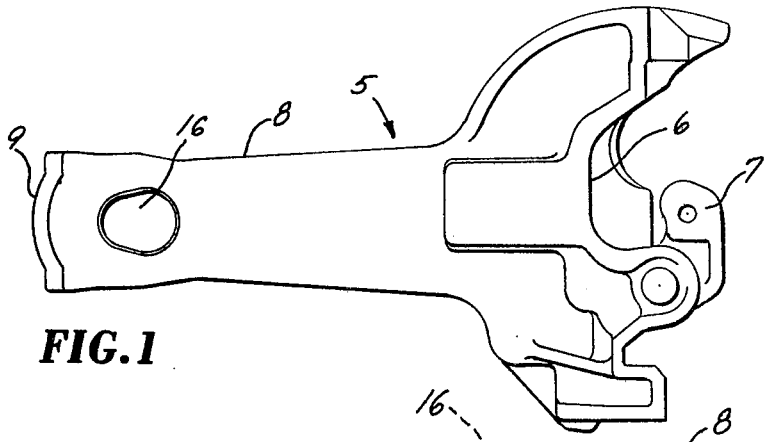
FIG. 1 is a plan view of a coupler.
Figure 2:
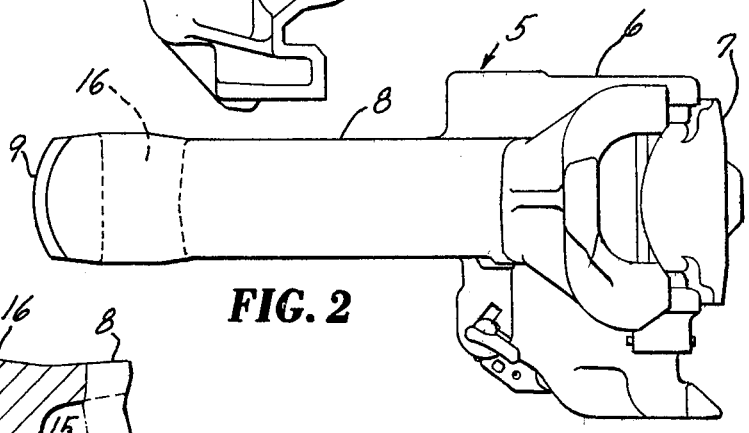
FIG. 2 is a side view of the coupler.

With reference to the drawing, there is shown a coupler 5 which comprises the essential components of a coupler head 6 with attached coupling means 7 and a shank 8 which extends from the coupler head 6 and terminates at a butt end 9 having a normally convexly curved outer surface 10 that rests in a matingly shaped concave seat 11 which is formed in an adjacent front follower 12. The butt end 9 of the coupler shank 8 is provided with a pair of stops 13,14 for restricting rotation of the coupler 5 about a pivot pin 15 which extends longitudinally through a pinhole 16 formed in the shank 8 of the coupler 5 adjacent the butt end 9. Some couplers do not have the stops 13,14, so that the butt end 9 of the coupler shank 8 is curved, as shown in dotted line of FIG. 3.

The butt end 9 of the coupler shank 8, employing the invention, is cast or machined flat, as indicated at 20. A cylindrical opening 21 with a center socket or hole 22 of substantially smaller diameter, is centrally recessed in the flat end 20 of the coupler shank 8.

A replaceable wearplate 23 is removably positioned within the opening or recess 21 disposed in the butt end 20 of the coupler shank 8. The wearplate 23 is generally mushroom shaped, having a cap 24 from which projects a cylindrical stem or plug 25 that is insertable in the more deeply recessed socket 22. The head or cap 24 of the mushroom-shaped wearplate 23 has a flat inner surface 26, which abuts the adjacent inner surface 27 of the recess 21, and a convexly curved outer surface 28 which corresponds to the shape of a conventionally curved butt end 9 of a coupler shank 8 which does not employ a wearplate at its butt end. The outer convex surface 28 of the cap 24 is, in essence, a segment of a sphere which completely covers and protects the wearing surface of the butt end of the shank. The cap 24 has a short-length, cylindrical circumferential edge 29 which connects its inner flat surface 26 and outer convex surface 28 and parallels an inner cylindrical marginal edge or periphery 30 of the recess 21.

The plug 25 which projects from the cap 24 is divided longitudinally into four segments 31–34 by a pair of intersecting slots 35,36 which are sufficiently sized so that the free distal ends of the plug segments 31–34 can be resiliently depressed towards each other to permit insertion of the plug 25 into the socket 22 which has an inside diameter that is slightly smaller than the outside diameter of the plug 25. The free distal end 37 of each of the segments 31–34 of the plug 25 is provided with a taper 38 to facilitate insertion of the plug 25 into the socket 22.

Figure 3:
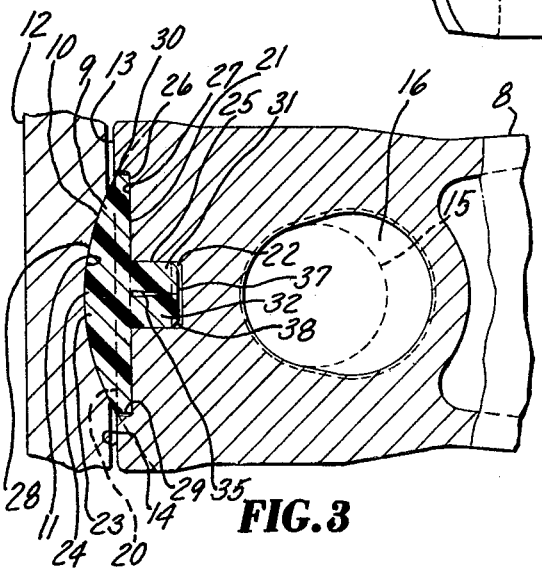
FIG. 3 is a section of the butt end of the shank and adjacent front follower of the coupler of FIG. 1, as viewed from a plane which is normal to the longitudinal axis of the pinhole.
Figure 4:
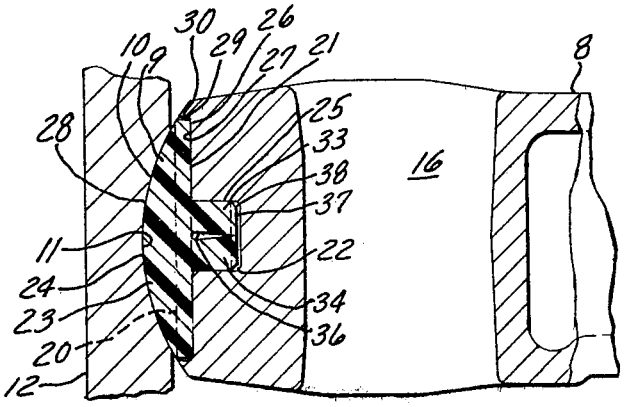
FIG. 4 is a section of the butt end of the shank and adjacent front follower of the coupler of FIG. 1, as viewed from a plane containing the longitudinal axis of the pinhole.
Figure 5:
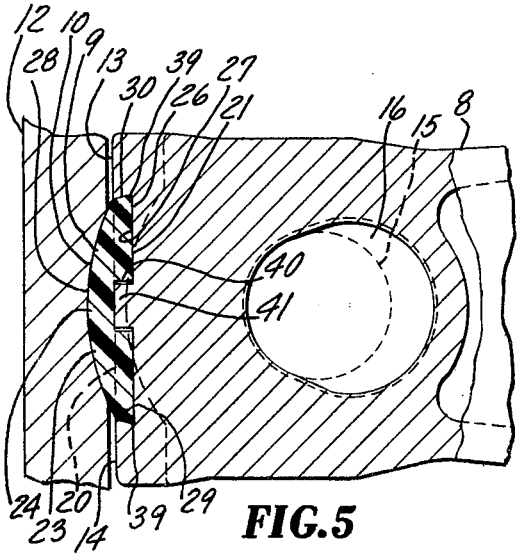
FIGS. 5 and 6 are sections similar to sections 3 and 4, but relate to another embodiment of the invention.

The wearplates 23 of FIGS. 3 and 5 are essentially the same, except for the plug 25 and fact that the adjacent edges 29,30 of the cap 24 and recess 21 are inclined relative to the center axis of the cap 24 and recess 21 to provide a friction fit between these two parts at their marginal edges. The inclined circumferential edge 29 of the cap 24, adjacent its inner flat surface 26, is provided with a taper 39 to facilitate insertion of the wearplate 23 into the recess 21. Such a friction fit at the marginal edges of the cap and recess may be provided in the embodiment of FIG. 3 if desired.

Figure 6:
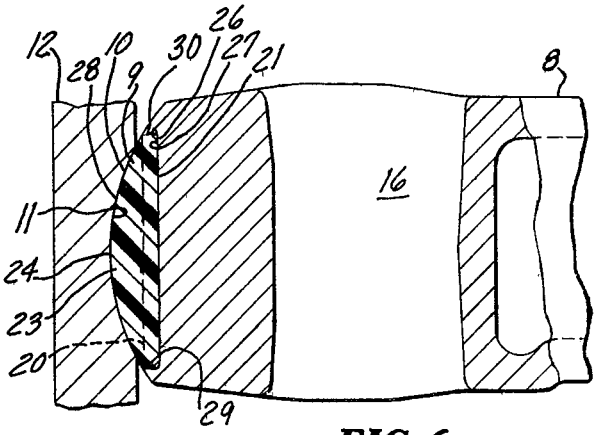

The wearplates 23 of FIGS. 5 and 6 may be provided with specially configured recessed slot 40 which is centrally disposed in the underside 26 of the cap 24 and designed to receive a matingly configured lug 41 that projects from the inner surface 27 of the recess 21. The coaction of the lug 41 and slot 40 prevents rotation of the wearplate 23 in the recess 21 and can be adapted to provide another friction fit between the wearplate and coupler shank. The lug 41 may be of any suitable shape, e.g. a rectangular, cross, triangular, or diamond cross-sectional configuration.

The wearplates 23 of FIGS. 3–6 are non-metallic, being composed of any suitable elastomeric material which is resilient, durable under stress, and preferably has a low coefficient of friction with metal so as not to require lubrication. Such a material is a plastic made and sold by the Holland Company of Illinois under the trademark HOLLUBE. This plastic is described in U.S. Pat. No. 4,055,254 as being an ultra high molecular weight polymer which is preferably a polyethylene having a molecular weight in the range of from 2,000,000 to 10,000,000 and a coefficient of sliding or dynamic friction with metal of a yoke or coupler shank of about .02.

Thus, there has been provided a simple wearplate for extending the life of a coupler shank which periodically needs replacement because of a badly worn butt end.

What is claimed is:

1. A car coupler, comprising:

(a) a coupler head with coupler means;

(b) a shank extending from the coupler head and terminating at a butt end having a configured recess disposed therein and extending inwardly of the shank in the direction of the coupler head;

(c) a replaceable wearplate disposed in the recess and having a spherical, convex outer surface which projects outwardly of the butt end of the shank and covers and seats against a concave surface of an adjacent front follower, the wearplate being a polyethylene having an ultra high molecular weight of from 2,000,000 to 10,000,000, the wearplate being generally shaped like the cap of a mushroom and having a short-length circumferential edge which is inclined at an angle to the center axis of the wearplate so that lines containing the edge converge in a direction away from the butt end of the shank and coupler head; and (d) means coacting between the shank and wearplate for frictionally holding the wearplate in the recess, including in the recess a matingly inclined cylindrical inner periphery which frictionally engages the circumferential edge of the wearplate.

2. The car coupler of claim 1, wherein the mushroom shaped cap includes a plug extending from the cap, and the means for frictionally holding the wearplate in the recess includes;

(e) means for longitudinally dividing the plug into segments having distal ends that are depressable towards each other; and (f) a socket extending inwardly of the recess for receiving the plug, the inside diameter of the socket being less than the outside diameter of the plug so that the plug becomes frictionally engaged in the socket upon insertion of the wearplate into the recess.

3. The car coupler of claim 1 which includes a configured slot and matingly shaped lug coacting between the wearplate and shank to restrict rotation of the wearplate in the recess about the center axis thereof.

4. A car coupler, comprising:

(a) a shank having a generally flat butt end;

(b) a cylindrical opening recessed in the flat butt end of the shank;

(c) a replaceable wearplate disposed in the opening and having a spherical convex surface projecting outwardly from the flat butt end of the shank, the wearplate being a polyethylene having an ultra high molecular weight in the range of from 2,000,000 to 10,000,000, the wearplate having at least the shape of a mushroom cap having an inner flat surface which is within the opening and connected to a spherical convex outer surface by a short-length circumferential edge; and (d) means for retaining the wearplate in the recessed opening, including an inner peripheral edge of the recessed opening matingly inclined with the edge of the cap, relative to the center axis of the opening, the edges each converging in a direction outwardly of the flat butt end of the shank.

5. The car coupler of claim 4, wherein the means includes a plug projecting from the inner flat surface of the cap, and a socket recessed in the opening for receiving the plug which has an outer diameter which is slightly larger than the inside diameter of the socket to provide a friction fit between the wearplate and shank.

6. The car coupler of claim 5, which includes means for longitudinally dividing the plug into a plurality of segments having free distal ends which are resiliently depressable towards each other.

7. The car coupler of claim 6, which includes a taper at the free distal ends of the plug segments to facilitate entrance of the segments into the socket.

8. A wearplate for protecting the butt end of a coupler shank whose butt end is designed to rest against a concavely curved spherical seat of an adjacent component, comprising:

(a) a removable plate having (i) an inner planar surface for engaging an adjacent flat end portion of the coupler shank, and (ii) a convexly curved spherical outer surface matingly configured for seating engagement with the seat, the area of the outer curved surface of the plate being greater than the area of the seat, and the wearplate being a polyethylene having an ultra-high molecular weight in the range of from 2,000,000 to 10,000,000; and (b) means for detachably mounting the plate on the flat end portion of the coupler shank, including a circumferential marginal edge of the plate connecting the inner and outer surfaces thereof, the marginal edge being angularly disposed relative to the center axis of the plate for frictionally engaging matingly angled adjacent sides of an opening recessed in the butt end of the coupler shank.

9. The wearplate of claim 8, wherein the mounting means includes a plug with an enlarged head extending from the planar surface of the plate, the head being divided into at least two segments by at least one transversely extending slot so that the segments are resiliently depressable towards each other.

* * * * *